US007614705B2

(12) United States Patent
Southern

(10) Patent No.: US 7,614,705 B2
(45) Date of Patent: Nov. 10, 2009

(54) WATER SPRAY ASSEMBLY

(76) Inventor: Philip W. Southern, One Lincoln Center, Shinnston, WV (US) 26341

( * ) Notice: Subject to any disclaimer, the term of this patent is extended or adjusted under 35 U.S.C. 154(b) by 0 days.

(21) Appl. No.: 12/216,566

(22) Filed: Jul. 8, 2008

(65) Prior Publication Data

US 2008/0272207 A1 Nov. 6, 2008

(51) Int. Cl.
*E21C 45/00* (2006.01)

(52) U.S. Cl. ..... 299/81.1; 299/12

(58) Field of Classification Search ..... 299/81.1, 299/81.2, 12, 81.3
See application file for complete search history.

(56) References Cited

U.S. PATENT DOCUMENTS 1,971,120 A * 8/1934 Rice et al. ..... 210/445
2,100,162 A * 11/1937 Fritz ..... 331/90
2,100,165 A * 11/1937 Holmberg et al.
2,418,766 A * 4/1947 Green
2,647,796 A * 8/1953 Ziherl ..... 239/470
3,107,060 A * 10/1963 Coursey, Jr. ..... 239/543
4,070,064 A * 1/1978 Cobb et al. ..... 299/81.1
4,664,450 A * 5/1987 Radford
5,253,807 A * 10/1993 Newbegin
5,407,253 A * 4/1995 Page et al.
6,540,304 B2 * 4/2003 Southern
2001/0045472 A1 * 11/2001 Southern ..... 239/550

* cited by examiner

*Primary Examiner*—John Kreck
(74) *Attorney, Agent, or Firm*—Clark & Brody

(57) ABSTRACT

A water spray assembly especially adapted for control of dust suppression in mining machines has a manifold with one or a number of nozzles mounted thereon. The manifold provides communication between the nozzles and a manifold inlet, the manifold inlet being adapted to connect to a supply of water. The manifold with one half of a quick connect coupling cooperates with a nozzle block having a bore sized to receive at least a portion of the manifold and the other half of the quick connect coupling. The use of quick connect coupling half with the block allows easy removal and insertion of the manifold.

11 Claims, 7 Drawing Sheets

60
63
65
61
66
68

63
45°
90°

66
65
70
72

6D
6D
73
71
21

75

75
45°
73

WATER SPRAY ASSEMBLY

This application claims priority under 35 USC 119(*e*) based on provisional patent application No. 60/547,881 filed on Feb. 27, 2004.

FIELD OF THE INVENTION

The present invention is directed to a water spray assembly, and in particular to a water spray assembly for mining equipment employing a removable manifold to facilitate changing of spray nozzles in difficult to reach areas.

BACKGROUND ART

In the prior art, water sprays are used in mining equipment, especially coal mining equipment, to suppress dust and wet the mined product. The sprays include nozzles, which are removably attached to manifolds or blocks, the blocks fixedly mounted to the mining machines at various locations. One problem with these sprays is plugging of the nozzles due to the coal, coal dust, iron oxide, and other foreign matter. The sprays must be continually cleaned for safety reasons and such maintenance reduces mining production. FIG. 1 shows a prior art spray system with a block 1 mounted on a portion of a continuous mining machine 3. The block 1 has a number of nozzles 5. A supply line 7 provides water to the nozzles for spraying purposes via a channel 9 within the block 1. Since these applications and types of mining machines are well known, a further description is not necessary for understanding of the invention.

SUMMARY OF THE INVENTION

It is a first object of the present invention to provide an improved water spray assembly, particularly one that is adapted for use on a mining machine.

Another object of the invention is a water spray assembly that permits easy removal for cleaning and repair.

One other object of the invention is a water spray assembly that utilizes a nozzle block and a manifold that is easily removed from the nozzle.

The invention allows the system to be continuously purged of plugging contaminants which otherwise would accumulate as occurs in prior art systems.

Other objects and advantages of the present invention will become apparent as a description thereof proceeds.

In satisfaction of the foregoing objects and advantages, the present invention provides an improvement in water sprays assemblies, particularly those that are mounted to mining machines for wetting and dust suppression.

The water spray assembly comprises a manifold containing one or more spray nozzles mounted thereto. The manifold has a passageway, which connects inlets of the nozzles to a manifold inlet. The manifold inlet is adapted to connect to a source of pressurized water via a hose or the like.

The manifold is received and supported by a nozzle block or housing. In a preferred embodiment, the housing is adapted to be attached to a location on a mining machine to spray water as part of the mining operation. One or more housings can be attached to the mining machine in a number of orientations and locations depending on the mining machine configuration. Of course, the housing and manifold could be adapted to mate with other components that utilize water sprays.

The nozzle block is configured to removably receive the manifold while providing one or more openings to allow the one or more spray nozzles of the manifold to direct the water spray in a given direction and/or orientation. By having the housing removably receive the manifold, the manifold can be easily removed when the one or more sprays become clogged. Another manifold with unobstructed nozzles can be inserted in the nozzle block while the manifold with the clogged nozzles is cleaned. Moreover, the nozzle block can be positioned on the machine so that an operator or user has ready access to the manifold for easy removal and reinstallation of another manifold.

The manifold can employ one or more nozzles and the nozzles can vary in spray pattern, flow rate, direction of spray and/or a combination of these variables. Virtually any nozzle can be employed in combination with the manifold.

The nozzles can be attached to the manifold by a threaded connection or any other connection as would be within the skill of the art.

The manifold shape is preferably circular in cross section of cylindrical in shape. Other cross sectional shapes could also be employed such as square, octagonal or the like.

The manifold material can be any material suitable for a particular application, but is preferably a material that is corrosion resistant while being capable of removably receiving the nozzles. One example is a nylon block which can be machined with threaded opening for the nozzles and water supply connection.

The water supply to the manifold can be provided by a hose having a threaded fitting which would connect to a threaded opening in the manifold. The connection between the manifold and hose could also be a quick connect fitting to facilitate removal of the manifold from the water supply hose for nozzle cleaning and/or replacement.

The inventive water spray assembly can be used in methods of spraying water, particularly for dust suppression in mining environments such as coal mines. The methods also involve the ability to remove the manifold component of the spray assembly for cleaning and repair, while leaving the housing place.

BRIEF DESCRIPTION OF THE DRAWINGS

Reference is now made to the drawings of the invention wherein.

DESCRIPTION OF THE PREFERRED EMBODIMENTS

The invention offers significant advantages over prior art water spray heads and the like which are fixedly mounted on machines or other equipment, particularly mining machines. The invention eliminates the need to remove one or more nozzles in cramped areas or hard-to access areas on a machine such as a mining machine for nozzle cleaning or replacement. With the inventive water spray assembly, the manifold is easily removed from the housing and replaced with another manifold having clear nozzles. No or hardly any time is lost as part of the nozzle replacement operation, thereby avoiding losses in productivity. In addition, personnel are kept out of harm's way via ease of the replacement procedure.

Figure 1:
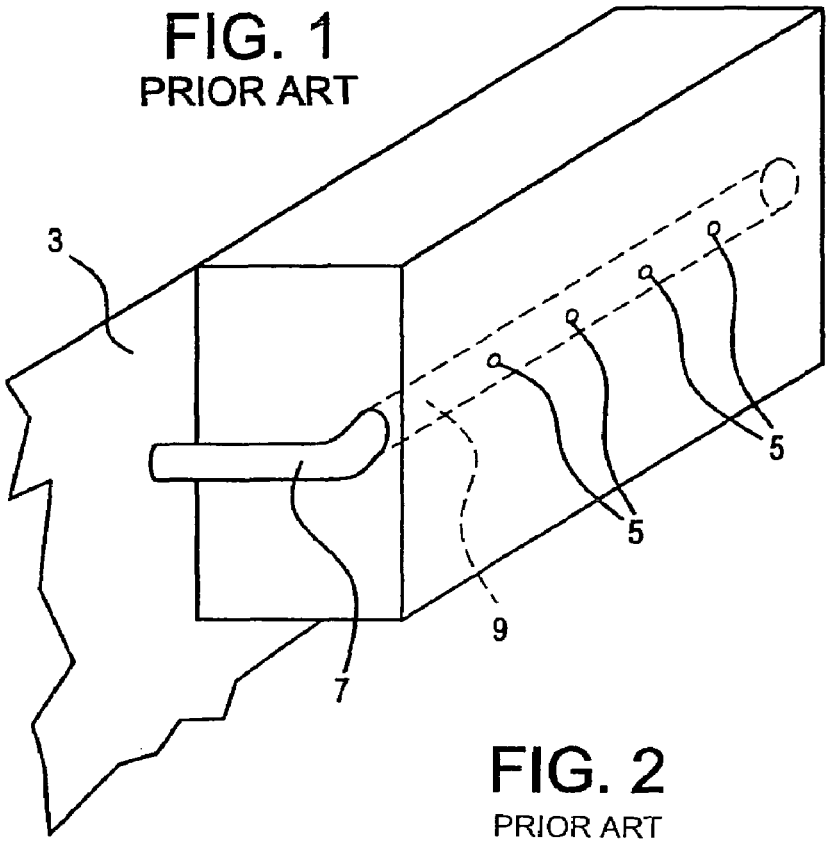
FIG. 1 PRIOR ART
FIG. 1 shows a prior art water spray nozzle arrangement typically used in mining machines.
Figure 2:
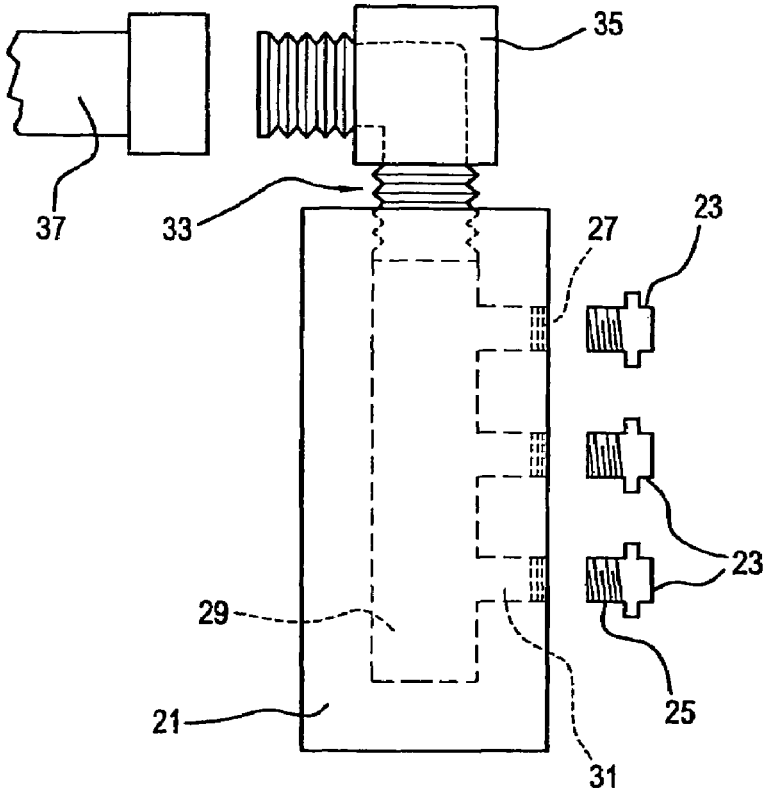
FIG. 2 PRIOR ART
FIG. 2 is a side view of one embodiment of the invention.
Figure 3:
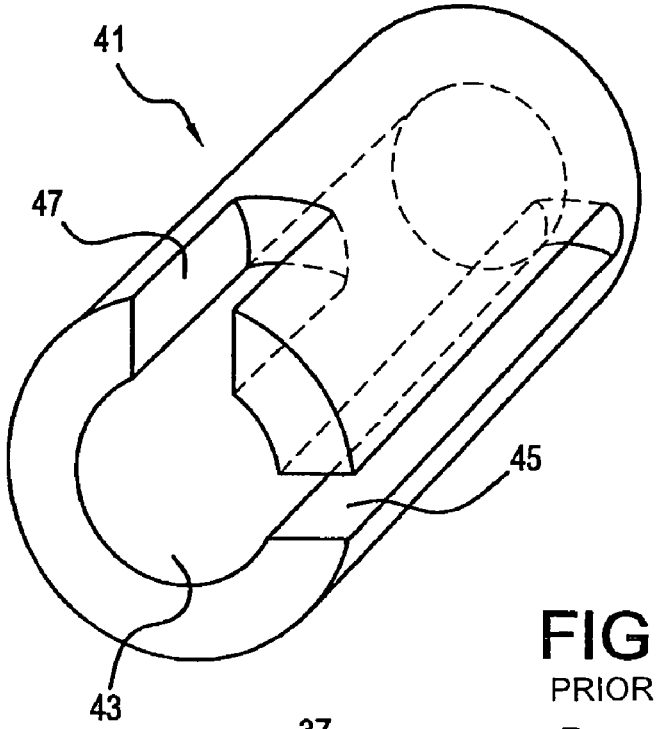
FIG. 3 PRIOR ART
FIG. 3 is a perspective view of the nozzle block of the invention.
Figure 4:
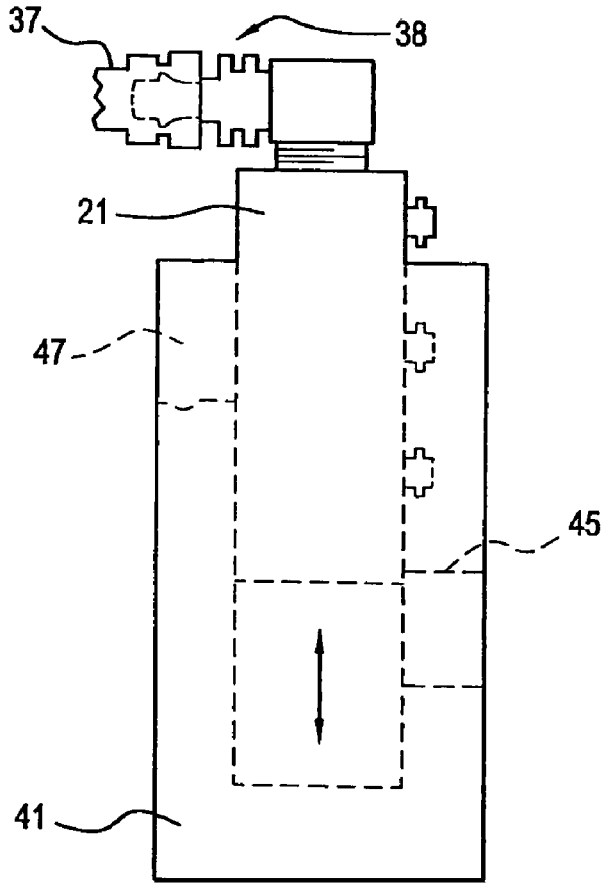
FIG. 4 PRIOR ART
FIG. 4 is a side view of the manifold and the nozzle block in partial engagement.

FIGS. 2-4 show one embodiment of the invention. FIG. 2 shows the manifold 21 having three nozzles 23. The nozzles 23 are threaded at 25 to mate with complementary threaded portions 27 of the manifold. The manifold has a passageway 29 interconnecting the nozzle channels 31 with an inlet 33.

The inlet is preferably threaded to receive a complementary threaded fitting 35. The fitting 35 interconnects the passageway 29 to a supply hose 37 to supply pressurized water to the nozzles 23. The supply hose 37 threads to the fitting 35.

Referring to FIG. 3, the nozzle block is designated as 41 and has a bore 43 sized to receive the manifold 21. The block 41 also has a slot 45 which allows travel of the nozzles when the manifold 21 is inserted into the bore 43 of the block. The manifold 21 can friction fit into the bore 43 or be locked in with some type of a locking mechanism, e.g., a pin, a detent mechanism or the like.

The slot 45 of the block can be sized as shown in FIG. 4 so that the nozzles are recessed from the block outer surface. In this way, the nozzles are more protected from impact from coal, coal dust, and other machinery, thereby lessening the chances of nozzle plugging or damage. Of course, the nozzles could be flush with the outer surface of the block or even extend outwardly therefrom is so desired.

The block 41 also can have a cutout 47 which is sized to accommodate the connection between the water supply and the manifold 21. The cutout 47 is shown at about a 90° from the slot 45 but other orientations could be used, e.g., the slot 45 could be opposite the cutout 47. In other embodiments, the cutout could be optional, e.g., the fitting 35 was not a 90°-type fitting but was aligned with a longitudinal axis of the manifold.

FIG. 4 shows a partial insertion of the manifold 21 into the block 41.

Figures 5A, 5B, 5C, 6A, 6B, 6C, 6D:
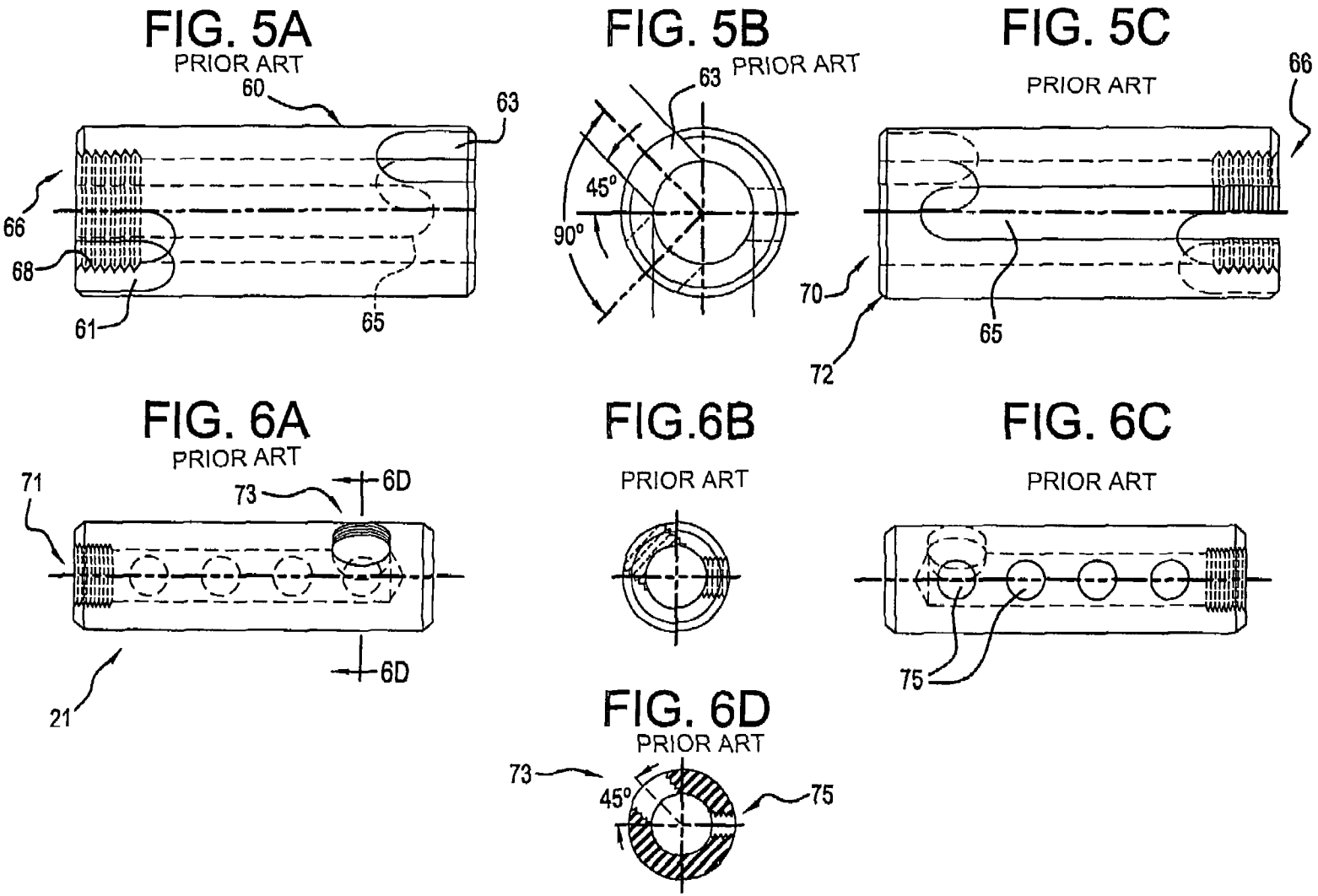
FIG. 5A PRIOR ART
FIG. 5B PRIOR ART
FIG. 5C PRIOR ART
FIG. 6A PRIOR ART
FIG.6B PRIOR ART
FIG. 6C PRIOR ART
FIG. 6D PRIOR ART
FIG. 5*a* is a back view of a nozzle block of a second embodiment of the invention.
FIG. 5*b* is an end view of the nozzle block of FIG. 5*a;*
FIG. 5*c* is a front view of the nozzle block of FIG. 5*a;*
FIG. 6*a* is a back view of a manifold to go with the nozzle block of FIGS. 5*a*-5*c;*
FIG. 6*b* is an end view of the manifold of FIG. 6*a;*
FIG. 6*c* is a front view of the manifold of FIG. 6*a;*
FIG. 6*d* is a sectional view along the line A-A of FIG. 6*a*.

FIGS. 5*a-c* and 6*a-d* show other embodiments of the block and manifold. The FIGS. 5*a*-5*c* embodiment shows the block with a threaded portion for connection with the manifold. FIG. 5*a* shows a back view of an exemplary 2.5" O.D.×1.5" I.D. steel tube nozzle block 60 showing two end slots 61, and 63. The end view of FIG. 5*b* shows the slots 61 and 63 arranged at a 90° angle. The slots 61 and 63 are preferably 1.5" long, and the end 66 of the tube has a threaded interior portion 68. FIG. 5*c* shows a third slot 65, which runs almost the length of the tube. The end 70 opposite end 66 has a chamfered edge 72, preferably a ⅛" chamfer. Each slot preferably terminates with a ⅜" radius shape.

The FIGS. 6*a*-6*c* show a manifold 21' with an inlet 71 and outlet 73. The manifold is preferably a 1.5" O.D. nylon rod. This differs from the FIG. 2 embodiment wherein the manifold has only an inlet. The manifold 21' preferably has a 4.5" deep bore with an opening tapped ¾" deep to ½" pipe. The outlet 73 is drilled and tapped to ½" pipe. FIG. 6*b* shows the relationship between the inlet 71 and the outlet 73, with FIG. 6*c* showing the channels 75 which correspond to the channels 31 of FIG. 2. FIG. 6*d* shows a sectional view wherein the relationship between channels 75 and the outlet 73 are shown. The channels are preferably drilled and left hand tapped to ¼" straight pipe, typically in four places. In the embodiment shown in FIGS. 5 and 6, the assembly can be positioned so that water entering inlet 71 can exit outlet 73 and be directed to other sprays or the like.

Although not shown, the manifold 21 could also have an outlet so that it could be connected to another manifold for a serial hook-up of nozzles.

The manifold could also employ a puller bar on one end thereof to facilitate removal from the block.

The block can be mounted by any means such as welding, fasteners, or the like, and can be either fixedly mounted are adjustably mounted.

FIGS. 7*a*-11 show another embodiment of the invention wherein the manifold has one half of quick connect fitting on one end and the block has the other half of the quick connect fitting associated with it and disposed at an end thereof. This arrangement is much more advantageous that the arrangement shown in the previous embodiments because the block and one half of the quick connect coupling can be secured at a desired location in a more permanent fashion, and only the manifold needs to be removed to clean or replace the spray nozzles.

Referring to FIGS. 7*a*-7*d*, the entire system is designated by the reference numeral 100. The system further includes a manifold 101 with nozzles 103, and a quick connect male fitting half 105 of a quick connect coupling that extends from manifold end 118. The manifold 101 is similar to that shown above with a bore providing communication between the openings in the nozzles 103 and source of water connected to the quick connect male fitting 105. The nozzle block is designated by the reference numeral 109, with the slot 111 for the nozzles and bore 112, and openings 113 for locking the manifold in place using the pin 115. The block 109 is sized so that the pin arms 117 fit around the recess 107 at the end of the manifold to hold the manifold in place. The other half of the quick connect coupling as the female fitting is designated by the reference numeral 119. The female fitting 119 has a first opening 123 to receive the male end 125 attached to the end 118 of the manifold. The fitting 119 also has an inlet 127 to provide communication between the manifold and a source of water for spraying.

Figure 8A:
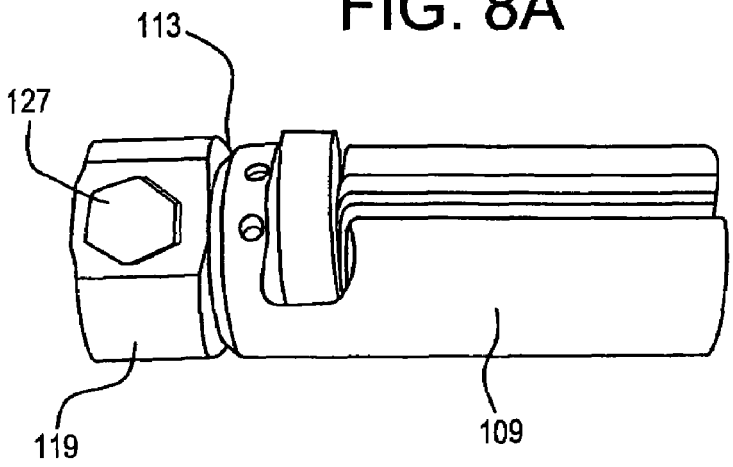
FIG. 8*a* is another perspective view of the manifold of the assembly.
Figure 8B:
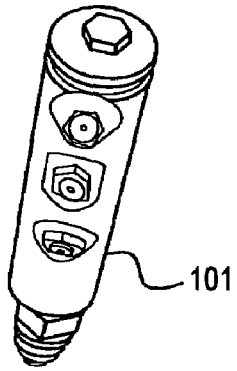
FIG. 8*b* is a perspective view of the nozzle block linked to one half of the quick connect assembly.
Figure 8C:
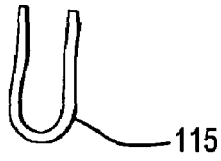
FIG. 8*c* is another perspective view of the pin of the assembly.

FIGS. 8*a*-8*c* show the female quick connect fitting 119 attached to the end 131 of the block. Although not shown, the block end 131, see FIG. 7*a*, has an opening, which aligns with the opening 123 in the fitting 119 so that the end 125 of male fitting 105 can connect with female fitting 119.

Figure 9:
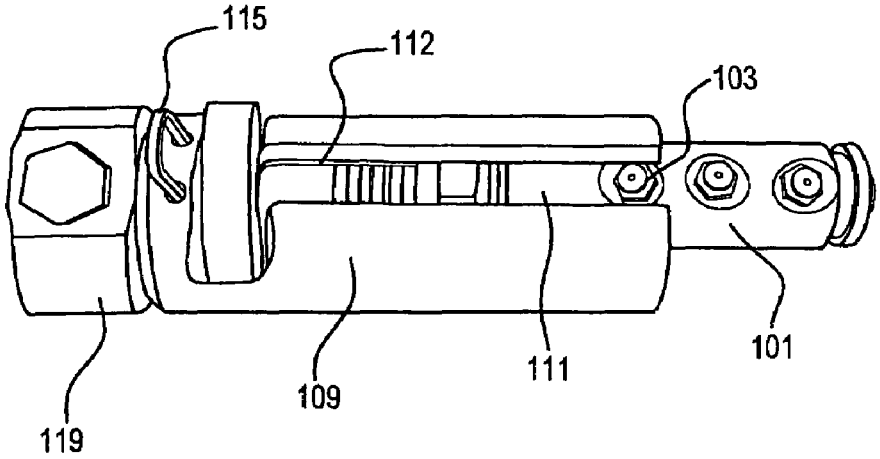
FIG. 9 is a perspective view of the manifold partially inserted into the nozzle block.

FIG. 9 shows the manifold 101 partially inserted into the bore 112 of the block 109, with the pin 115 partially entering the openings 113. Notice that the nozzles 103 align with the slot 111.

Figure 10A:
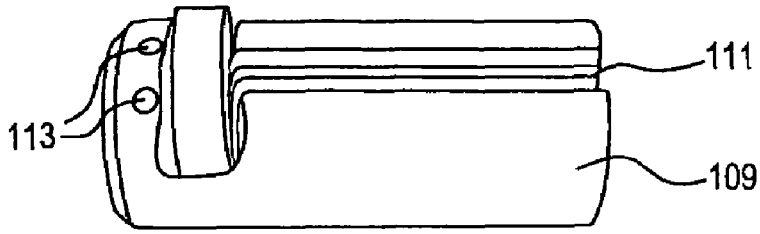
FIG. 10*a* is a perspective view of the nozzle block.
Figure 10B:
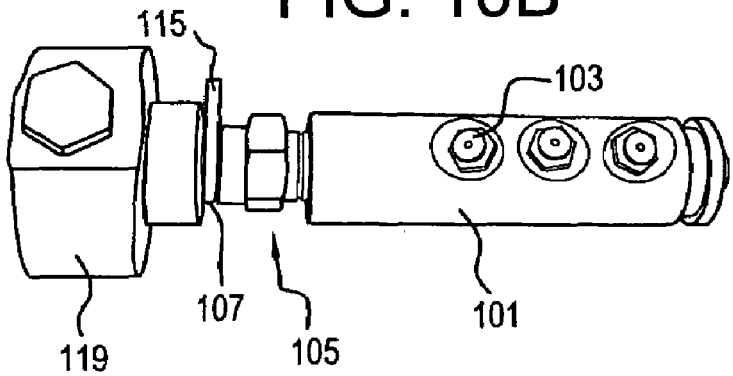
FIG. 10*b* is a perspective view of the manifold connected to the one half of the quick connect assembly using the pin.

FIGS. 10*a* and 10*b* show quick connect fittings 105 and 119 connected outside of the block 109 to more clearly show the engagement between the pin arms 117 and the recess 107 on the male fitting 105.

Figure 11:
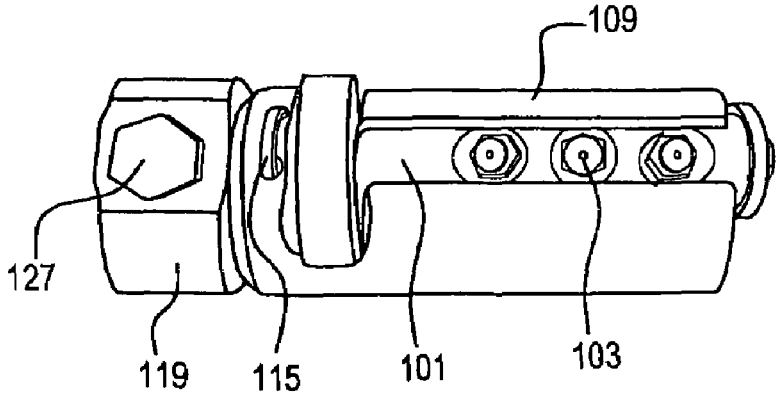
FIG. 11 is a perspective view of the completed water nozzle assembly.

FIG. 11 shows the system completely assembled wherein the male fitting 105 and female fitting 119 are joined so that the nozzles 103 are in communication with inlet 127 of the fitting 119 so that water can be supplied to the nozzles 103 for spraying.

The manifold in the FIG. 7 embodiment with the one or more nozzles has the quick connect fitting aligned with an axial bore of the manifold, unlike the embodiments shown above, wherein the manifold includes an elbow so that an axis of the quick connect fitting is perpendicular to the axial bore of the block. In addition, the block is open on each end, one end allowing insertion and removal of the manifold, with the other end being open so that the quick connect fitting half on the manifold can engage the other half of the fitting which is located adjacent the other open end of the block.

The invention entails both the combination of the block and the manifold, as well as the manifold itself as uniquely adapted to interface with the block. While the male fitting is shown on the manifold with the female fitting associated with the block, the nozzle and manifold could be sized so that the manifold would contain the female fitting with the male fitting associated with the block. However, it is preferred that the manifold contain the male fitting since the alternative arrangement requires the nozzle bore and manifold to be larger to handle the female fitting.

The attachment between the block and fitting can be done in any manner, for example, welding or mechanical attachment. As an alternative, the block could be attached to another structure, with the quick connect fitting placed in the proper position with respect to the block and attached to other structure as well, thus leaving the block and fitting unattached. Preferably though, the block and quick connect fitting are attached together.

Figure 7A:
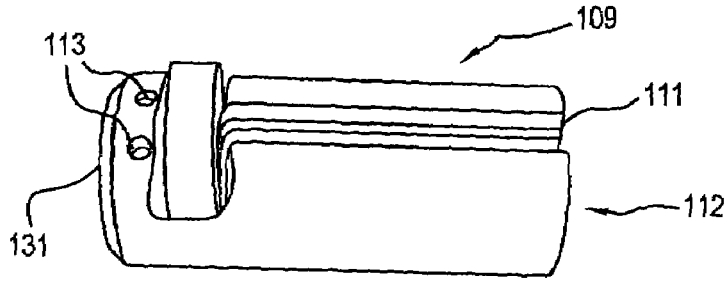
FIG. 7*a* is a perspective view of a nozzle block of the water spray assembly.
Figure 7B:
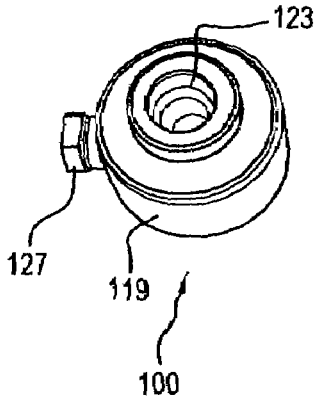
FIG. 7*b* is a perspective view of one-half of a quick connect fitting of the assembly.
Figure 7C:
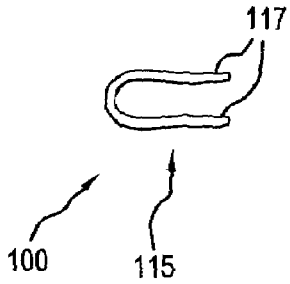
FIG. 7*c* is a perspective view of a pin used in the assembly.
Figure 7D:
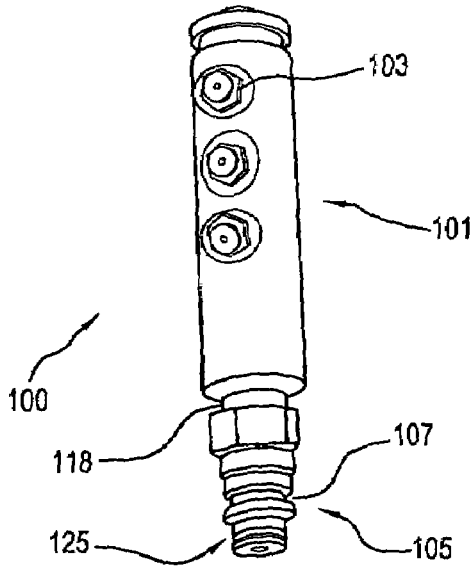
FIG. 7*d* is a perspective view of a manifold for the assembly.
Figure 12:
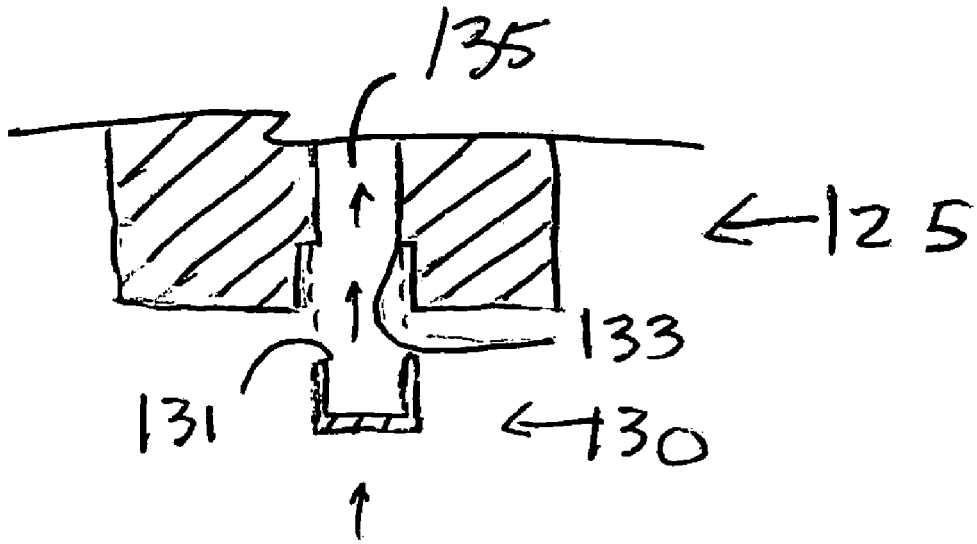
FIG. 12 is a cross sectional view of an alternative embodiment of the manifold of FIGS. 7-11.

Another aspect of the invention entails providing a wire mesh basket which fits over the inlet at the male fitting end 125 that receives water for spraying. The wire mesh basket acts as a filter to prevent particles from passing through the manifold and clogging the nozzle openings. The basket is attached to the male end in such a way so that the quick connect fitting can still function, but debris in the water being supplied to the manifold is filtered prior to entering the nozzles. A cross section of the end 125 of the manifold of FIG. 7D is shown in FIG. 12 as one example of the mesh basket embodiment. The basket is designated by the reference numeral 130, and has a collar 131 that interfaces with a lip 133 formed on an interior of the inlet 135 of the male fitting end 125. The lip can be formed by boring out the inlet to a diameter sized to receive the collar 131 of the mesh basket 130. The depth of the bore is made to match the height of the collar 131 so that when the basket 130 is installed, the basket top is flush with the end face of the male fitting end 125. The mesh part 137 of the basket 130 extends within the manifold inlet 135, so as to prevent debris from entering the inlet 135 and clogging the nozzles 103, see FIG. 7D. The wire basket collar 131 can be distorted in one mode to snugly fit into the inlet 135 so that fasteners are not required. However, fasteners could be employed to keep the basket in place, if desired. Of course, other ways as would be known to those of skill in the art can be employed to combine the basket with the male end 125. It should be also understood that the mesh basket could be employed on the embodiment shown in FIGS. 1-6, and particularly in conjunction with the threaded fitting 35. The same design could be employed on fitting 35 wherein the inlet would be modified to receive the wire mesh basket.

While the mesh size of the basket can vary depending on the nozzle sizes and target impurity sizes, a preferred mesh size of 30 mesh, although smaller or larger meshes, e.g., 18, 20, and 24, 35, 40, 50, 60 and so on, can be employed.

As such, an invention has been disclosed in terms of preferred embodiments thereof which fulfills each and every one of the objects of the present invention as set forth above and provides new and improved water spray assembly and its use with mining machine.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A water spray manifold comprising a manifold of longitudinal length and having an axial bore running along the longitudinal length, and a plurality of spaced apart nozzles mounted along the longitudinal length of the manifold, the manifold providing communication between the spaced apart nozzles and a manifold inlet, the manifold inlet having on an end thereof one half of a quick connect coupling, with the coupling axially aligned with the axial bore, wherein the manifold has a generally uniform cross sectional shape along its longitudinal length, wherein the manifold has a groove adapted to receive a retaining pin intended to keep the manifold in a nozzle block in combination with a retention function of the one half of the quick connect coupling.

2. The manifold of claim 1, wherein the groove is positioned between an end of the one half of the quick connect coupling and the spaced apart nozzles.

3. The manifold of claim 1, further comprising a wire mesh basket covering the manifold inlet.

4. A water spray assembly comprising:

a) the manifold of claim 1, manifold of longitudinal length and having an axial bore running along the longitudinal length, and a plurality of spaced apart nozzles mounted along the longitudinal length of the manifold, the manifold providing communication between the spaced apart nozzles and a manifold inlet, the manifold inlet having on an end thereof one half of a quick conned coupling, with the coupling axially aligned with the axial bore;

b) a block having a bore sized to receive at least a portion of the manifold, the block adapted to be mounted for directing the spaced apart nozzles in a particular directions the block having a first opening on one end that is sized to receive at least a portion of the manifold, and a second opening on the other end, each of the first and second openings aligned with each other along an axis of the block; and c) the other half of a quick connect coupling aligned with the second opening of the block, and adapted to connect to the one half of the quick connect fitting on the manifold, the other half including an inlet to provide communication between a source of water and the spaced apart nozzles.

5. The assembly of claim 4 in combination with a mining machine.

6. The assembly of claim 4, wherein the block has a slot in communication with the bore to allow the spaced apart nozzles that extend outwardly from the manifold to travel in the slot when the manifold is inserted into the bore keeping the manifold in a fixed and correctly aligned position.

7. The assembly of claim 6, wherein the slot is sized so that the spaced apart nozzles are recessed from an outer surface of the block.

8. A method of replacing nozzles in a water spray assembly comprising:

a) inserting a water spray manifold of claim 1 into a block adapted to receive the manifold and supply water thereto, the manifold having the spaced apart nozzles in clean or new form, and b) linking the one half of the quick connect coupling with a second half of the quick conned coupling that is part of the block; and/or b) removing the manifold from a block and the second half of the quick conned coupling when at least one of the spaced apart nozzles becomes inoperable, the end of the manifold with the one half of the quick conned coupling exiting the block last.

9. In a method of at least suppressing dust on a mining machine using water sprays, the improvement comprising:

a) providing a water spray assembly of claim 4; and b) spraying water therefrom for said dust suppression.

10. The method of claim 9, wherein the water is sprayed on coal mined by the mining machine.

11. The manifold of claim 1, wherein the manifold is cylindrical in shape.

* * * * *

UNITED STATES PATENT AND TRADEMARK OFFICE

CERTIFICATE OF CORRECTION

PATENT NO. : 7,614,705 B2
APPLICATION NO. : 12/216566
DATED : November 10, 2009
INVENTOR(S) : Phillip W. Southern It is certified that error appears in the above-identified patent and that said Letters Patent is hereby corrected as shown below:

Title page, item [30]
Domestic Priority Data should be included as follows:
This application is a continuation of 11/064,847 filed February 25, 2005, now abandoned.

Signed and Sealed this

Third Day of August, 2010

David J. Kappos

David J. Kappos
*Director of the United States Patent and Trademark Office*